US005651389A

United States Patent [19]

Anderson

[11] Patent Number: 5,651,389

[45] Date of Patent: Jul. 29, 1997

[54] METHOD AND APPARATUS FOR CONTROLLING TANK VAPORS

[76] Inventor: R. David Anderson, 110 Pembroke, Wichita Falls, Tex. 76301

[21] Appl. No.: 707,825

[22] Filed: Sep. 4, 1996

Related U.S. Application Data

[63] Continuation of Ser. No. 362,793, Dec. 22, 1994, abandoned.

[51] Int. Cl.[6] ..... F04B 23/02

[52] U.S. Cl. ..... 137/565; 417/393

[58] Field of Search ..... 137/565; 417/393

[56] References Cited

U.S. PATENT DOCUMENTS

| | | | |
|---|---|---|---|
| 740,892 | 10/1903 | Meyer | 417/393 |
| 1,453,561 | 5/1923 | Willshaw | 417/393 |
| 2,239,715 | 4/1941 | Hollander et al. | 417/393 |
| 3,329,094 | 7/1967 | Harklau et al. | 417/393 |
| 4,123,204 | 10/1978 | Scholle | 417/393 |
| 4,658,760 | 4/1987 | Zebuhr | 417/393 X |
| 4,830,583 | 5/1989 | Edson | 417/393 X |
| 5,135,360 | 8/1992 | Anderson et al. | 417/53 |
| 5,139,390 | 8/1992 | Rajewski | 417/53 |
| 5,195,587 | 3/1993 | Webb | 166/252 |

*Primary Examiner*—John Rivell

*Attorney, Agent, or Firm*—Charles D. Gunter, Jr.

[57] ABSTRACT

A method and apparatus are shown for controlling tank vapors on a petroleum storage tank of the type having a tank vapor line which leads from the storage tank for transporting relatively low pressure gas vapor to a relatively higher pressure gas sales line. An intensifier piston is installed in the tank vapor line between the storage tank and the gas sales line. The intensifier piston is operated to increase the pressure of the gas vapor exiting the petroleum storage tank to a higher relative discharge pressure, whereby the higher pressure discharge gas can be passed directly to the gas sales line.

6 Claims, 2 Drawing Sheets

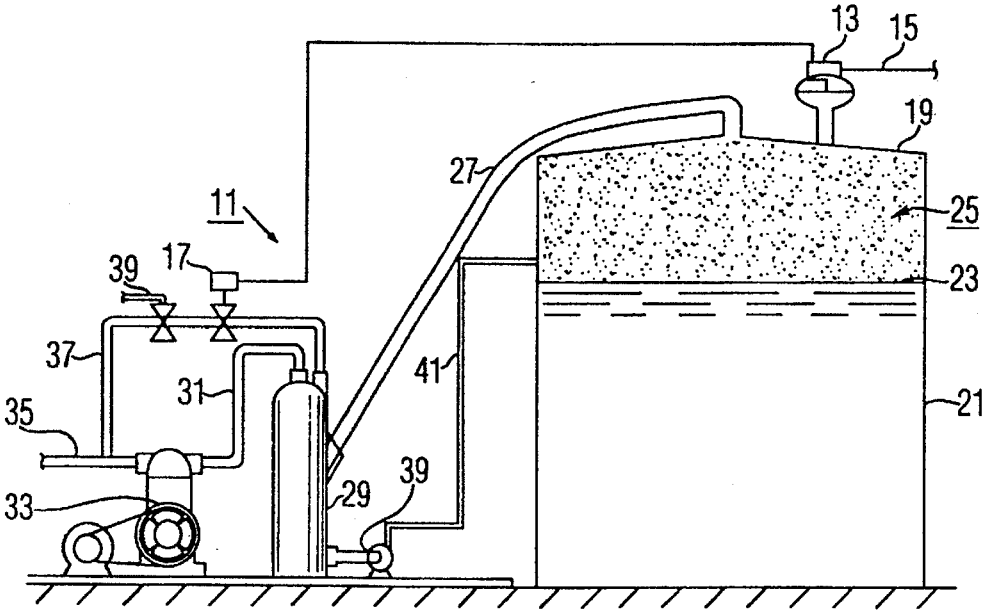
PRIOR ART FIG. 1
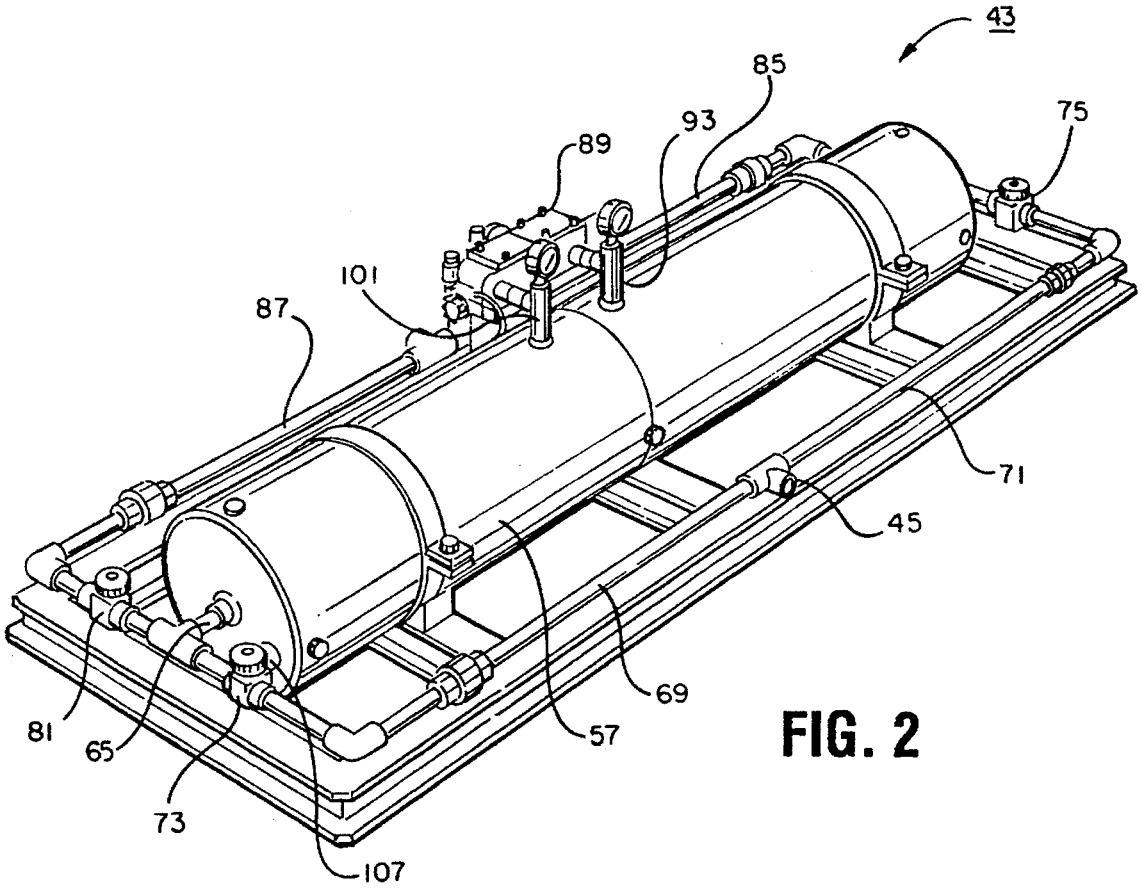
FIG. 2

METHOD AND APPARATUS FOR CONTROLLING TANK VAPORS

This is a continuation of application Ser. No. 08/362,793, filed Dec. 22, 1994 now abandoned.

BACKGROUND OF THE INVENTION

1. Field of the Invention

The present invention relates generally to vapor recovery systems and methods and, specifically, to a vapor recovery system for recovering vapors from a petroleum storage tank in order to deliver the vapors to a gas sales line.

2. Description of the Prior Art

In a typical petroleum production facility, the product from a producing well is first passed to an oil and gas separator, with the liquid petroleum being passed to a petroleum storage tank. The liquified portion of the tank contents are periodically emptied and transported.

While pentane and other heavier components of the tank contents are typically liquid, gaseous vapors develop in the upper portion of such tanks as the gases come out of solution in the process liquids. Vapor recovery units have been popular for a number of years. If the tank vapors are present in sufficient quantity to economically justify their recovery, it is often expedient to collect the tank vapors and compress the vapors to the point that they can be delivered to a gas sales line, where the vapor is sold in the gaseous state. Previously, if such sales lines were not present or if the gaseous vapor did not occur in sufficient quantity, the vapors were sometimes vented to the atmosphere or were burned in a flare.

The passage of the Clean Air Act, combined with more stringent enforcement of local air quality standards, have together obsoleted certain of the previous disposal methods. The newer air quality regulations increase the demand for systems that find ways to avoid disposing of storage tank vapors into the atmosphere either by direct venting or flaring. The more stringent emission control standards result in a need for disposal systems which have, in the past, been economically prohibitive. For many production operations, the difference between shutting down a well and keeping the well in production depends upon how economically the vapor emissions can be controlled.

The prior art vapor recovery methods have suffered from a number of deficiencies. Skid mounted gas collection and compression units require the use of a gas compressor which is relatively expensive to install and operate. Such units require a number of motors to operate and maintenance on the compressors is fairly high due to the abundance of mechanically moving parts, normal wear and tear, and the like.

It is an object of the present invention to provide an improved system and method for controlling tank vapors on a petroleum storage tank.

Another object of the invention is to provide a method for efficiently recovering tank vapors for sale which does not increase greatly the cost or complexity of the present operation.

Another object of the invention is to provide a non-electric recovery system which eliminates fire and explosion hazards.

Another object of the invention is to provide an improved vapor recovery system which meets the requirements of the Clean Air Act and which requires low capital expenditure and has low maintenance and operating cost.

SUMMARY OF THE INVENTION

A method is shown for controlling tank vapors on a petroleum storage tank of the type having a tank vapor line leading from the petroleum storage tank for transporting relatively low pressure gas vapor to a relatively higher pressure gas sales line. An intensifier piston is installed in the tank vapor line intermediate the petroleum storage tank and the gas sales line. The intensifier piston is operated to increase the pressure of the gas vapor exiting the petroleum storage tank to a higher relative discharge pressure, whereby the higher pressure discharge gas can be passed directly to the gas sales line. The intensifier piston is driven by means of an inlet gas. The inlet gas has a higher relative pressure than the required discharge pressure of the higher pressure discharge gas which is discharged from the intensifier piston. A control means is provided for cycling the intensifier piston, whereby the relatively lower pressure gas vapor exiting the petroleum storage tank is drawn into the intensifier piston at a selected end and a relatively higher pressure discharge gas is discharged at an opposite end of the intensifier piston.

The present invention also includes a system for collecting gas vapors from a storage tank in an oil field production facility of the type which collects hydrocarbon fluids being produced from a well into a facility at the well's surface. The facility includes a petroleum storage tank for storing an oil component of a hydrocarbon fluid to await further processing and a gas collection line for passing gas separated from the hydrocarbon fluid. The system includes a vent means on the petroleum storage tank and a flowline means in fluid communication with the vent means on the petroleum storage tank for venting gas vapors from the petroleum storage tank. An intensifier piston is located in the flowline means for increasing the pressure of the relatively lower pressure gas vapor exiting the petroleum storage tank to a higher relative discharge pressure, whereby the higher pressure discharge gas can be passed directly to the gas collection line. The intensifier piston preferably includes an inlet for a higher pressure drive gas, the higher pressure drive gas being at a higher relative pressure than the required discharge pressure of the higher pressure discharge gas which is discharged from the intensifier piston.

Preferably, the intensifier piston includes at least two pistons mounted on a common piston rod. The at least two pistons are located within a generally cylindrical piston chamber, the piston chamber having gas passages located at either of opposite ends thereof for alternatingly receiving and discharging gas vapor which is exiting the petroleum storage tank. A control means is provided for cycling the intensifier piston, whereby relatively lower pressure gas vapor exiting the petroleum storage tank is drawn into the intensifier piston at a selected end thereof and relatively higher pressure discharge gas is discharged at an opposite end of the intensifier piston. The preferred control means is a shuttle valve. The system for controlling gas vapors also preferably includes a sensing means for sensing the relative location of the pistons within the piston chamber and for causing the control means to cycle as the pistons move in reciprocal fashion within the piston chamber. In a preferred embodiment, the sensing means includes a pair of poppet valves, one of the pair of poppet valves being located at each selected end of the piston chamber and being contactable by a selected piston, whereby contact between the piston and the selected poppet valve signals the control means to begin a new cycle. The gas passages located at each end of the generally cylindrical piston chamber are preferably each provided with a pair of check valves which alternately allow the inlet of a relatively low pressure gas vapor from the petroleum storage tank and the discharge of a relatively higher pressure discharge gas as the sensing means causes the control means to cycle.

Additional objects, features and advantages will be apparent in the written description which follows.

BRIEF DESCRIPTION OF THE DRAWINGS

FIG. 1 is a simplified view of a prior art vapor recovery unit showing a scrubber and a mechanically operated compressor used to increase the pressure of the tank vapor in order to transmit the vapor to a gas sales line;

FIG. 2 is a perspective view of the intensifier piston used in the system of the invention;

DETAILED DESCRIPTION OF THE INVENTION

Figure 5:
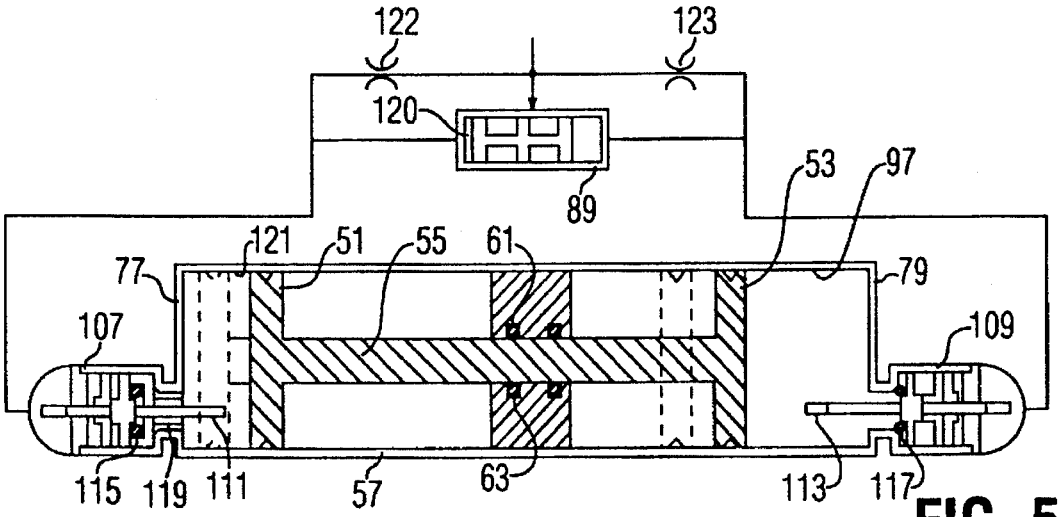
FIG. 5 is a simplified, schematic view of the intensifier piston of the invention showing the operation of the sensing and control means of the invention.

FIG. 1 shows a prior art vapor recovery system designated generally as 11. The vapor recovery system 11 included an electrically actuated tank pressure pilot 13 connected to an electrical source by a lead 15 and connected to an electrically actuated bypass control valve 17. The tank pressure pilot 13 was mounted on the top 19 of a petroleum storage tank 21, the tank having a liquid level 23 and a vapor head 25. The pressure pilot 13 was operated to maintain a positive pressure on the order of two ounces per square inch on the liquid 23 and within a downwardly sloping oil tank vapor line 27. The vapor line 27 ran to a scrubber unit 29 which was, in turn, connected by a conduit 31 to a reciprocating compressor 33. The compressor had a compressed vapor discharge line 35 leading to a gas sales line. A bypass line 37 communicated vapor from the discharge line 35, through a manually operated flow rate control valve 39, and through the electrically actuated bypass control valve 17 to return vapor to the scrubber unit 29.

In operation, an increase in tank pressure above the tank pressure set point (approximately two ounces per square inch) actuated the pressure pilot 13, causing the pilot to close the bypass control valve 17. This action allowed the compressor 33 to send vapor to the gas sales line through the discharge line 35. As the pressure in the tank began to fall, the pressure pilot 13 opened the bypass control valve 17, causing the compressor to stop sending vapor to the gas sales line. As liquid hydrocarbons accumulated in the suction scrubber 29, they were pumped back to the petroleum storage tank 21 by means of a return pump 39 and a return conduit 41.

FIG. 2 shows the intensifier piston, designated generally as 43, which is used in the method for controlling tank vapors of the invention. The intensifier piston 43 has a tank vapor inlet (45 in FIG. 3) which would be connected to the vapor line 27 of the oil storage tank 21 shown in FIG. 1 intermediate the petroleum storage tank and the gas sales line (not shown). The intensifier piston 43 is operated to increase the pressure of the gas vapor exiting the petroleum storage tank through the line 27 to a higher relative discharge pressure, whereby the higher pressure discharge gas can be passed directly to the gas sales line.

Figure 3:
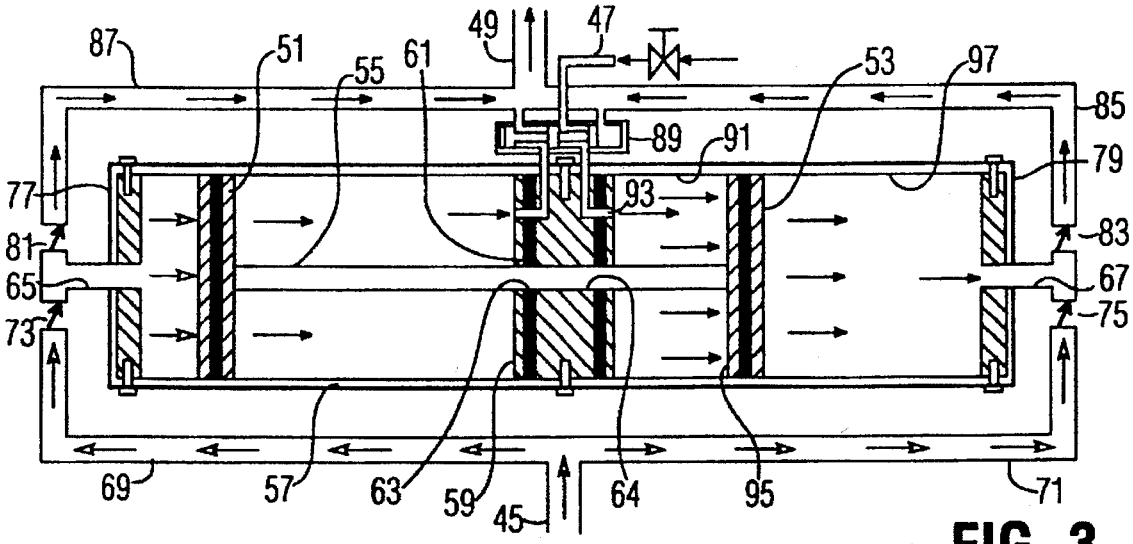
FIG. 3 is a simplified, schematic view of the operation of the intensifier piston of FIG. 2 as the piston moves in a first direction.

As shown in FIG. 3, the intensifier piston 43 also includes an inlet 47 for a high pressure drive force and a piston outlet 49. The high pressure drive force is preferably a gas which is at a higher relative pressure than the required discharge pressure of the higher pressure discharge gas which is discharged from the intensifier piston through the outlet 49. The high pressure drive gas can be provided, for example, by separator vents present at the petroleum facility (pressures ranging from about 1500 psig down to about 20 psig), from gases being discharged by other gas compressors or from gas pressure taken from the another high pressure gas sales line present at the petroleum production facility which typically has about a 1000 psig maximum pressure. However, it will be understood by those skilled in the art that the high pressure drive force could be provided from a suitable higher pressure liquid available from any convenient source or compressed air.

The intensifier piston 43 includes at least two pistons 51, 53 (FIG. 3) which are mounted on a common piston rod 55 and which are supported within the generally cylindrical piston housing 57 by means of a seal structure 59. The seal structure 59 allows sliding movement of the piston rod 55 so that the pistons 51, 53 are allowed to reciprocate backwards and forwards within the cylindrical housing 57. Sealing can be accomplished by a suitable O-ring arrangement 61, 63, located within the bore 64 provided within the seal structure 59, or by any other suitable sealing means familiar to those skilled in the art. In one embodiment of the invention, the pistons had 8 inch diameters and the piston rod had a 36 inch stroke.

While the embodiment of the invention illustrated uses only two pistons 51, 53 on the common piston rod 55, it will also be appreciated by those skilled in the art that additional pistons 51, 53 could be mounted thereon. In other words, some multiple number of pistons, such as two, could be located within each chamber 97. By increasing the number of pistons 51, 53, the surface area available for intensifying the gas pressure increases and the required diameter of each individual piston in the chamber is generally decreased.

The cylindrical piston housing 57 has opposing gas passages 65, 67 located at either of opposite ends thereof for alternatingly receiving gas vapor which is exiting the petroleum storage tank and for discharging a relatively higher pressure gas. As shown in FIG. 3, the tank vapor (at about 1.5 inches w.c.) entering the flowline 45 is directed through conduits 69, 71 and through one-way check valves 73, 75 to either of the opposite ends 77, 79 of the piston housing 57. Similar one-way check valves 81, 83 allow compressed vapor to enter the conduits 85, 87 which communicate with the outlet 49 for conveying the intensified vapor (at, e.g., 50 psig) to the gas sales line.

A control means is provided for cycling the intensifier piston, whereby relatively lower pressure gas vapor exiting the petroleum storage tank is drawn into the intensifier piston at a selected end thereof and relatively higher pressure discharge gas is discharged at an opposite end of the intensifier piston. Any suitable control means can be provided for cycling the intensifier. In the preferred embodiment shown, the control means is a shuttle valve 89 which cycles so that the piston rod makes about one stroke every four seconds. As shown in FIG. 3, the shuttle valve is in a first position which routes high pressure drive gas entering inlet 47 to the chamber region 91 by means of conduit 93.

This causes a force to be applied to the rear face 95 of the piston 53 causing the piston to move to the right as viewed in FIG. 3. Movement of piston 53 to the right compresses the vapor within the chamber region 97, causing higher pressure vapor to exit the gas passage 67 and pass through check valve 83 and conduit 85 to the outlet 49 leading to the gas sales line.

Figure 4:
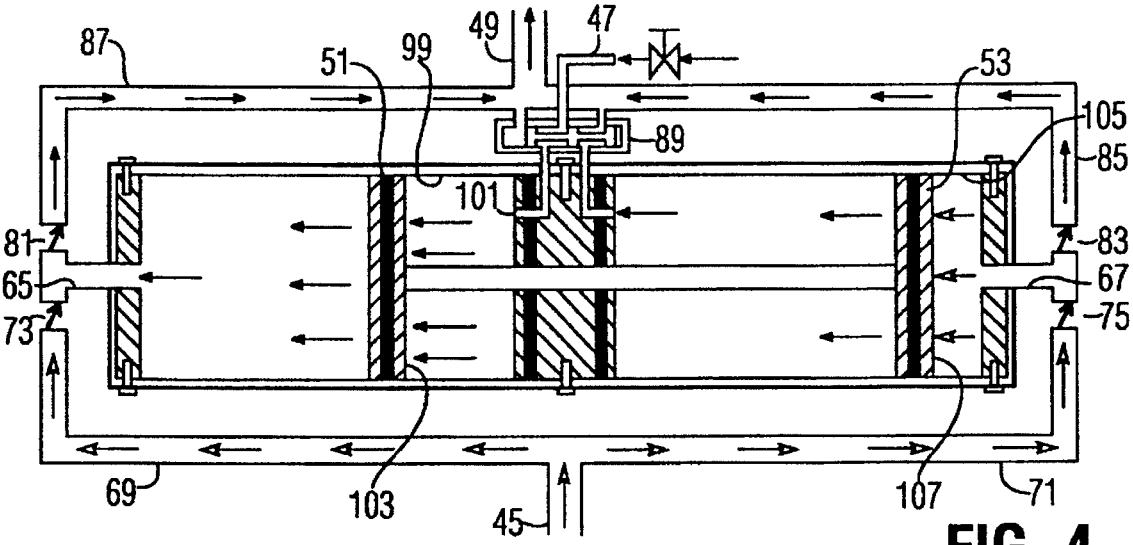
FIG. 4 is a simplified schematic view, similar to FIG. 3, showing the operation of the intensifier piston as the piston moves in a second direction.

As shown in FIG. 4, when the shuttle valve 89 is in the second, shifted position, high pressure drive gas entering the inlet 47 passes to the chamber region 99 by means of conduit 101, thereby applying an oppositely directed force to the rear face 103 of the piston 51. This force causes the piston to move to the left, as viewed in FIG. 4, causing higher pressure vapor to be expelled from the gas passage 65 and through check valve 81 and conduit 87 to the outlet 49 leading to the gas sales line. As the piston 51 moves to the left, tank vapor passing from the tank vapor line (27 in FIG. 1) is drawn into the vapor inlet 45 so that vapor enters the conduits 69, 71. Movement of the pistons to the left creates a vacuum within the chamber region 105 which draws tank vapor through the check valve 75 and through the gas passage 67 into the chamber region behind the face 107 of piston 53. In this way, a selected end of the intensifier piston is alternatively filled with a relatively low pressure gas vapor exiting the petroleum storage tank while gas vapor is simultaneously being discharged at a relatively higher discharge pressure by movement of the piston in a given direction. The control means cycles the intensifier piston so that relatively low pressure gas vapor is allowed to fill one end of the piston chamber while gas is being discharged from the opposite chamber region thereof.

Any suitable sensing means can be provided for sensing the relative location of the pistons within the piston chamber and for causing the control means to cycle, thereby causing the pistons to move in reciprocal fashion within the piston chamber. In the embodiment illustrated in FIG. 5, the sensing means is a pair of poppet valves 107, 109 located at each selected end 77, 79 of the piston chamber, each poppet valve including a stem 111, 113 which is contactable by a selected piston, whereby contact between the piston and the selected poppet valve signals the control means, in this case shuttle valve 89 to begin a new cycle. Each poppet valve 107, 109 has a seal region 115, 117 which contacts a valve seat to prevent the flow of gas through the respective passageway 119. At equilibrium, both seal regions 115, 117 are seated on the respective valve seats and the spool valve 89 is at rest. In the position shown in FIG. 5, the piston 51 is about to contact the valve stem 111 of poppet valve 107 causing the seal region 115 to become unseated. This action opens the poppet valve 107 allowing a reduction of pressure in chamber 120 of the shuttle valve 89 causing the valve to shift to a new position. Elements 122 and 123 are small orifices to restrict the flow of gas to the poppets.

An invention has been provided with several advantages. The method for controlling tank vapors of the invention is simple in design and relatively inexpensive to manufacture. Electrical requirements and rotating components of the type used in the prior art reciprocating compressor systems are eliminated. With few moving parts, the intensifier piston allows continued operation with minimum maintenance and lower operating cost than did the prior art systems. The power for driving the intensifier piston is furnished from a gas or liquid at a higher pressure than the required discharge pressure of the vapor which is discharged into the gas discharge line. The higher pressure gas can be provided, for example, by separator vents present at the petroleum facility, from gases being discharged by other gas compressors or from gas pressure taken from the high pressure transmission (gas sales) line. The driving force for operating the intensifier piston could also be taken from a suitable higher pressure liquid available from any convenient source.

While the invention has been shown in only one of its forms, it is not thus limited but is susceptible to various changes and modifications without departing from the spirit thereof.

What is claimed is:

1. A method for controlling tank vapors on a petroleum storage tank located at a petroleum facility, the storage tank having a tank vapor line leading from the petroleum storage tank for transporting relatively low pressure gas vapor to a relatively higher pressure gas sales line, the method comprising the steps of:

installing an intensifier piston in the tank vapor line intermediate the petroleum storage tank and the gas sales line;

operating the intensifier piston to increase the pressure of the gas vapor exiting the petroleum storage tank to a higher relative discharge pressure, whereby the higher pressure discharge gas can be passed directly to the gas sales line;

driving the intensifier piston by means of an inlet gas taken from a source available at the petroleum facility, the inlet gas having a higher relative pressure than the required discharge pressure of the higher pressure discharge gas which is discharged from the intensifier piston;

providing a control means for cycling the intensifier piston, whereby relatively lower pressure gas vapor exiting the petroleum storage tank is drawn into the intensifier piston at a selected end thereof and relatively higher pressure discharge gas is discharged at an opposite end of the intensifier piston;

wherein the control means is a shuttle valve; and wherein the inlet gas used to drive the intensifier piston is combined with the higher pressure discharge gas which is discharged from the intensifier piston during cycling of the intensifier piston, whereby the intensifier piston operates as a closed system with no emissions.

2. A method of removing collected vapor from a petroleum storage tank located at a petroleum facility with an intensifier piston, the method comprising the steps of:

alternatingly filling a selected end of the intensifier piston with a relatively low pressure gas vapor exiting the petroleum storage tank and discharging the gas vapor at a relatively higher discharge pressure by movement of the piston in a first direction;

providing a control means for cycling the intensifier piston so that relatively low pressure gas vapor is allowed to fill an opposite end of the intensifier piston while gas is discharged from the first selected piston end;

operating the control means to cycle the intensifier piston so that relatively low pressure gas vapor exiting the petroleum storage tank is increased in pressure and discharged at the increased pressure to a gas sales line; and wherein the piston is driven by means of an inlet gas taken from a source available at the petroleum facility, the inlet gas having a higher relative pressure than the required discharge pressure of the higher pressure discharge gas which is discharged from the intensifier piston; and wherein the inlet gas used to drive the intensifier piston is combined with the higher pressure discharge gas which is discharged from the intensifier piston during cycling of the intensifier piston, thereby diluting the discharge gas and forming a closed system which contains not only the storage tank vapor being collected but also the inlet gas used to drive the piston.

3. In an oil field production facility for collecting hydrocarbon fluids being produced from a well into a facility at the well's surface, the facility including a petroleum storage tank for storing an oil component of a hydrocarbon fluid to await further processing and a gas collection line for passing gas separated from the hydrocarbon fluid, a system for collecting gas vapors from the storage tank in the facility, comprising:

vent means on the petroleum storage tank;

a flowline means in fluid communication with the vent means on the petroleum storage tank for venting gas vapors from the petroleum storage tank;

an intensifier piston located in the flowline means for increasing the pressure of the relatively lower pressure gas vapor exiting the petroleum storage tank to a higher relative discharge pressure, whereby the higher pressure discharge gas can be passed directly to the gas collection line;

wherein the intensifier piston includes an inlet for a high pressure drive gas, the high pressure drive gas being at a higher relative pressure than the required discharge pressure of the higher pressure discharge gas which is discharged from the intensifier piston;

wherein the intensifier piston includes at least two pistons mounted on a common piston rod, the at least two pistons being located within a generally cylindrical piston chamber, the piston chamber having gas passages located at either of opposite ends thereof for alternatingly receiving and discharging gas vapor which is exiting the petroleum storage tank;

a shuttle valve for cycling the intensifier piston, whereby relatively lower pressure gas vapor exiting the petroleum storage tank is drawn into the intensifier piston at a selected end thereof and relatively higher pressure discharge gas is discharged at an opposite end of the intensifier piston;

sensing means for sensing the relative location of the pistons within the piston chamber and for causing the control means to cycle as the piston moves in reciprocal fashion within the piston chamber; and wherein the sensing means is a pair of poppet valves, one of said pair of poppet valves being located at each selected end of the piston chamber and being contactable by a selected piston, whereby contact between the piston and the selected poppet valve signals the control means to begin a new cycle.

4. The system of claim 3, wherein the gas passages located at each end of the generally cylindrical piston chamber each have associated therewith a pair of check valves which alternately allow the inlet of relatively low pressure gas vapor from the petroleum storage tank and the discharge of relatively higher pressure discharge gas as the sensing means causes the control means to cycle.

5. A method for controlling tank vapors on a petroleum storage tank located at a petroleum facility, the storage tank having a tank vapor line leading from the petroleum storage tank for transporting relatively low pressure gas vapor to a relatively higher pressure gas sales line, the method comprising the steps of:

installing an intensifier piston in the tank vapor line intermediate the petroleum storage tank and the gas sales line;

operating the intensifier piston to increase the pressure of the gas vapor exiting the petroleum storage tank to a higher relative discharge pressure, whereby the higher pressure discharge gas can be passed directly to the gas sales line;

driving the intensifier piston by means of an inlet gas taken from a source available at the petroleum facility, the inlet gas having a higher relative pressure than the required discharge pressure of the higher pressure discharge gas which is discharged from the intensifier piston;

providing a control means for cycling the intensifier piston, whereby relatively lower pressure gas vapor exiting the petroleum storage tank is drawn into the intensifier piston at a selected end thereof and relatively higher pressure discharge gas is discharged at an opposite end of the intensifier piston;

wherein the control means is a shuttle valve; and wherein the source of inlet gas available at the petroleum facility used to drive the intensifier piston is gas taken from a separator vent present at the petroleum facility.

6. A method of removing collected vapor from a petroleum storage tank located at a petroleum facility with an intensifier piston, the method comprising the steps of:

alternatingly filling a selected end of the intensifier piston with a relatively low pressure gas vapor exiting the petroleum storage tank and discharging the gas vapor at a relatively higher discharge pressure by movement of the piston in a first direction;

providing a control means for cycling the intensifier piston so that relatively low pressure gas vapor is allowed to fill an opposite end of the intensifier piston while gas is discharged from the first selected piston end;

operating the control means to cycle the intensifier piston so that relatively low pressure gas vapor exiting the petroleum storage tank is increased in pressure and discharged at the increased pressure to a gas sales line;

wherein the piston is driven by means of an inlet gas taken from a source available at the petroleum facility, the inlet gas having a higher relative pressure than the required discharge pressure of the higher pressure discharge gas which is discharged from the intensifier piston; and wherein the source of inlet gas available at the petroleum facility used to drive the intensifier piston is gas taken from a separator vent present at the petroleum facility.

* * * * *